US006598711B2

(12) United States Patent
Barmet

(10) Patent No.: US 6,598,711 B2
(45) Date of Patent: Jul. 29, 2003

(54) INDICATING DEVICE

(75) Inventor: Lukas Barmet, Luzern (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/109,383

(22) Filed: Mar. 28, 2002

(65) Prior Publication Data

US 2002/0139289 A1 Oct. 3, 2002

(30) Foreign Application Priority Data

Mar. 28, 2001 (EP) ..... 01810315

(51) Int. Cl.[7] ..... B66B 3/00
(52) U.S. Cl. ..... 187/395; 116/64; 187/391
(58) Field of Search ..... 187/380, 395, 187/391, 396, 397, 398, 399; 116/3, 64, 68, 202, 280, 305; 340/393.3, 815.69, 815.7, 815.49, 815.73, 815.74

(56) References Cited

U.S. PATENT DOCUMENTS 2,525,769 A * 10/1950 Burns ..... 327/518
4,019,607 A * 4/1977 Mandel et al. ..... 187/395
4,022,296 A * 5/1977 Mandel et al. ..... 187/395
D283,687 S * 5/1986 Walser ..... D10/108
5,243,162 A * 9/1993 Kobayashi ..... 200/512
5,565,661 A 10/1996 Berdich et al.
5,679,934 A * 10/1997 Juntunen et al. ..... 187/395
6,011,839 A * 1/2000 Friedli et al. ..... 379/167.02
6,161,654 A * 12/2000 Sirigu et al. ..... 187/391
6,227,335 B1 * 5/2001 Koeppe, Jr. et al. ..... 187/414
6,502,668 B1 * 1/2003 Chida et al. ..... 187/395

FOREIGN PATENT DOCUMENTS

EP 0 403 232 12/1990

* cited by examiner

*Primary Examiner*—Jonathan Salata
(74) *Attorney, Agent, or Firm*—Macmillan, Sobanski & Todd, LLC

(57) ABSTRACT

An indicating device for an elevator installation includes an electroluminescent indicator and a sound-reproducing apparatus, wherein the sound-reproducing apparatus is glued to a rear side of the electroluminescent indicator. The electroluminescent indicator and the sound-reproducing apparatus are mounted on a frame that snaps into a housing to form a module that can be attached to a wall mount.

17 Claims, 4 Drawing Sheets

INDICATING DEVICE

BACKGROUND OF THE INVENTION

The present invention relates to an indicating device for elevators, wherein the indicating device includes an electroluminescent indicator and a sound reproducing apparatus.

As used in this application, an indicating device is a device that enables the reproduction of visual and/or acoustic data.

As used in this application, a sound reproducing apparatus is any apparatus that converts electrical signals into acoustic, audible signals, for example into words, music, especially sound tones and so forth.

There is shown in the European patent specification EP 0 403 232 an electroluminescent display system for an elevator that includes not only an electroluminescent screen for the visual representation of elevator data, but also a loudspeaker for acoustic reproduction of elevator data. The electroluminescent screen is constructed with a plurality of pixels and has a glass plate front side for display of the illuminated pixels. The loudspeaker lies in the same plane as the electroluminescent screen, but at a specific spacing therefrom.

A disadvantage of this known device is that a separate place for the loudspeaker has to be provided around the electroluminescent screen and at a spacing therefrom. The screen is a thin-film electroluminescent screen which uses a glass plate as a support material. This necessarily causes a thicker construction of the finished display system. Thus, this display device requires quite a large amount of installation space in the elevator installation, with associated higher production and installation costs.

SUMMARY OF THE INVENTION

The invention concerns an indicating device of the type described above, which does not have the aforesaid disadvantages and which is space-saving.

This indicating device for an elevator installation includes an electroluminescent indicator and a sound-reproducing apparatus, wherein the sound-reproducing apparatus is arranged at a side of the electroluminescent indicator.

An advantage of the indicating device according to the present invention is that apart from the electroluminescent indicator, no separate space away from the indicator, is necessary for the sound-reproducing apparatus.

In one embodiment, the sound-reproducing apparatus is connected with the electroluminescent indicator. This has the advantage that the indicating device according to the present invention can be of compact construction. The sound-reproducing apparatus and the electroluminescent indicator can be assembled as one part.

In a further embodiment, the sound-reproducing apparatus is connected with the electroluminescent indicator by means of an adhesive. This leads to a simple and uncomplicated capability of assembly of the electroluminescent indicator with the sound-reproducing apparatus.

In a further embodiment, the sound-reproducing apparatus and the electroluminescent indicator are arranged one behind the other. In this embodiment the advantage is that the construction space required only in the depth direction and not in width. Thus, the projection of the electroluminescent indicator onto a surface determines the requisite amount of area for mounting the entire indicating device.

The sound-reproducing apparatus and the electroluminescent indicator of the present invention can be arranged between a frame and a housing. This provides a stable combination of the electroluminescent indicator and the sound-reproducing apparatus in the indicating device.

In addition, the sound-reproducing apparatus can be constructed as a flat loudspeaker. This leads to a thin mode of construction of the indicating device. This form of loudspeaker can be glued in simple manner with the electroluminescent indicator, whereby the high qualitative sound properties are not lost.

In a further embodiment, the electroluminescent indicator is constructed in accordance with the principle of thick-film electroluminescence. This has the advantage that no glass plate is required at the front side of the electroluminescent indicator, which leads to a space-saving construction and favorable capability of manufacture. The illuminated side is constructed to be very thin and can be glued in a problem-free manner in front of sound-reproducing apparatus. Moreover, such electroluminescent indicators produce an area illumination, which leads to a homogeneous illumination.

In addition, the electroluminescent indicator can be constructed as an electroluminescent lamp. This embodiment permits the use of a single electroluminescent lamp, which can be controlled in simple manner. Two terminals are sufficient for driving the electroluminescent lamp.

Moreover, the indicating device according to the present invention includes a fixing means so that the indicating device can be attached to a wall of the elevator installation. In particular, the fixing means is a wall mount. The indicating device can be mounted quickly and in stable manner to a wall by using such a fixing means.

All features of the indicating device according to the present invention are usable not only in the respectively indicated combinations, but also in other combinations or by themselves without departing from the scope of the invention.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
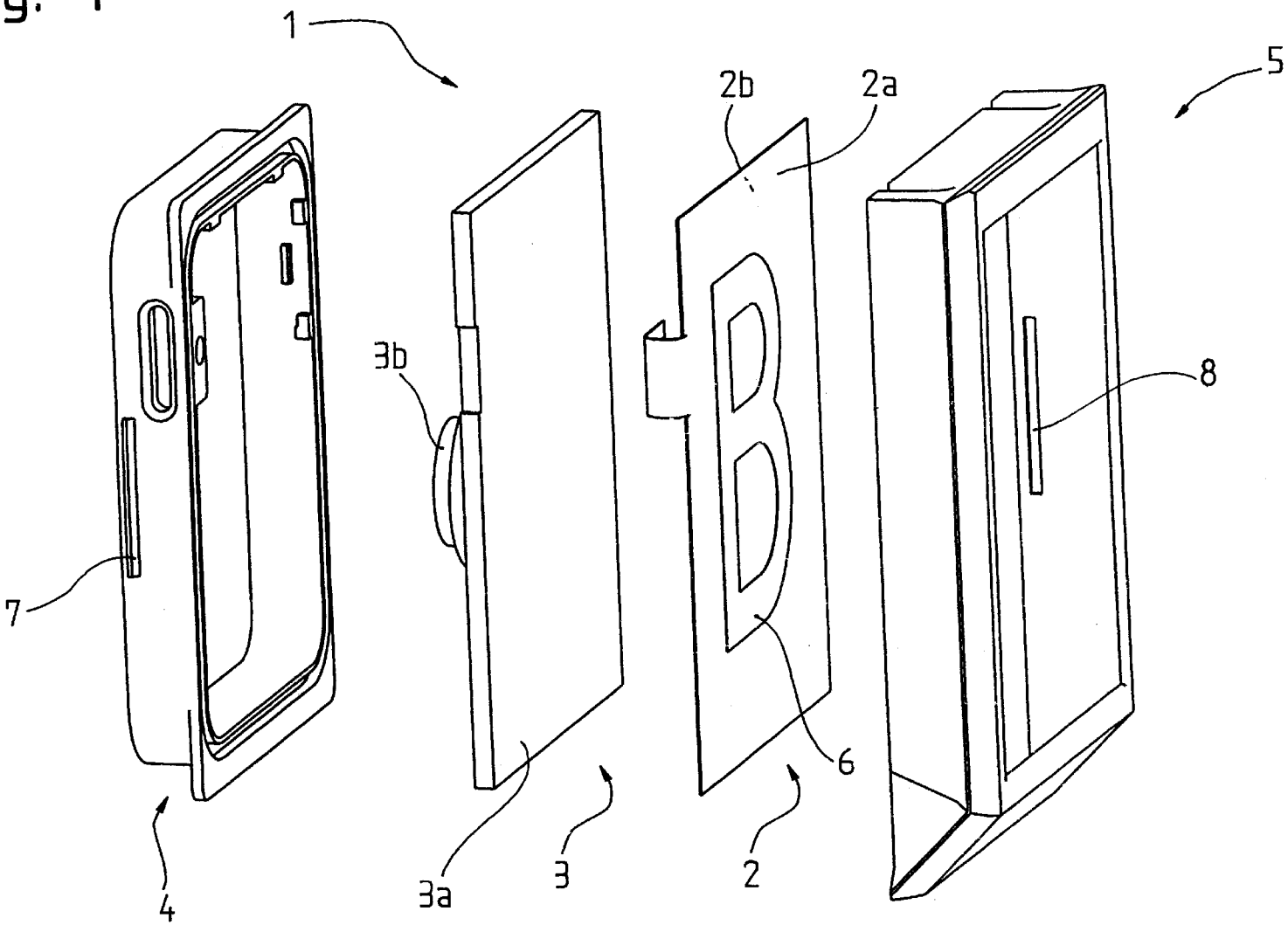
FIG. 1 is an exploded perspective view of an indicating device according to one embodiment of the present invention.

FIG. 1 shows some components of an indicating device 1 for an elevator installation in a disassembled state. An electroluminescent indicator 2 and a sound-reproducing apparatus 3 are arranged in a stacked alignment for mounting in a frame 4 and a housing 5. In this example, the electroluminescent indicator 2 is constructed as an electroluminescent lamp and the sound-reproducing apparatus 3 is constructed as a flat loudspeaker. The flat loudspeaker 3 includes a generally rectangular panel 3*a* and an exciter 3*b* mounted on a back or rear surface of the panel. The electroluminescent lamp 2 is shown as an electroluminescent film. For the sake of simplicity the term electroluminescent is abbreviated in the following description to the designation "EL".

A symbol 6, for example in the form of a letter "B", denotes an elevator or an elevator group and is applied to a front surface 2*a* of the EL film 2. The indicating device 1 can be arranged above an elevator door on a floor of a building or at another favorable position. The EL film 2 and the flat loudspeaker 3 are assembled together with the frame 4 and the housing 5. The frame 4 is formed as a generally rectangular box with an open front side while the housing 5 has a similar shape with open front and rear sides. The frame 4 has formed at its outer circumference, on side walls, lateral projections 7 which detent in corresponding complementary cut-outs 8 formed in an inner circumference, side walls, of the housing 5. Thus, when the frame 4 and the housing 5 are assembled together by inserting the frame into the open rear side of the housing, each of the lateral projections 7 engages a corresponding one of the cut-outs 8. A simple snap connection is thereby achieved. Only one projection 7 and one cut-out 8 are shown in FIG. 1, but one or more of each can be provided in each of the side walls of the frame 4 and the housing 5. The frame 4 is constructed so that in the installed state there is no distortion of the flat loudspeaker 3.

Figure 2:
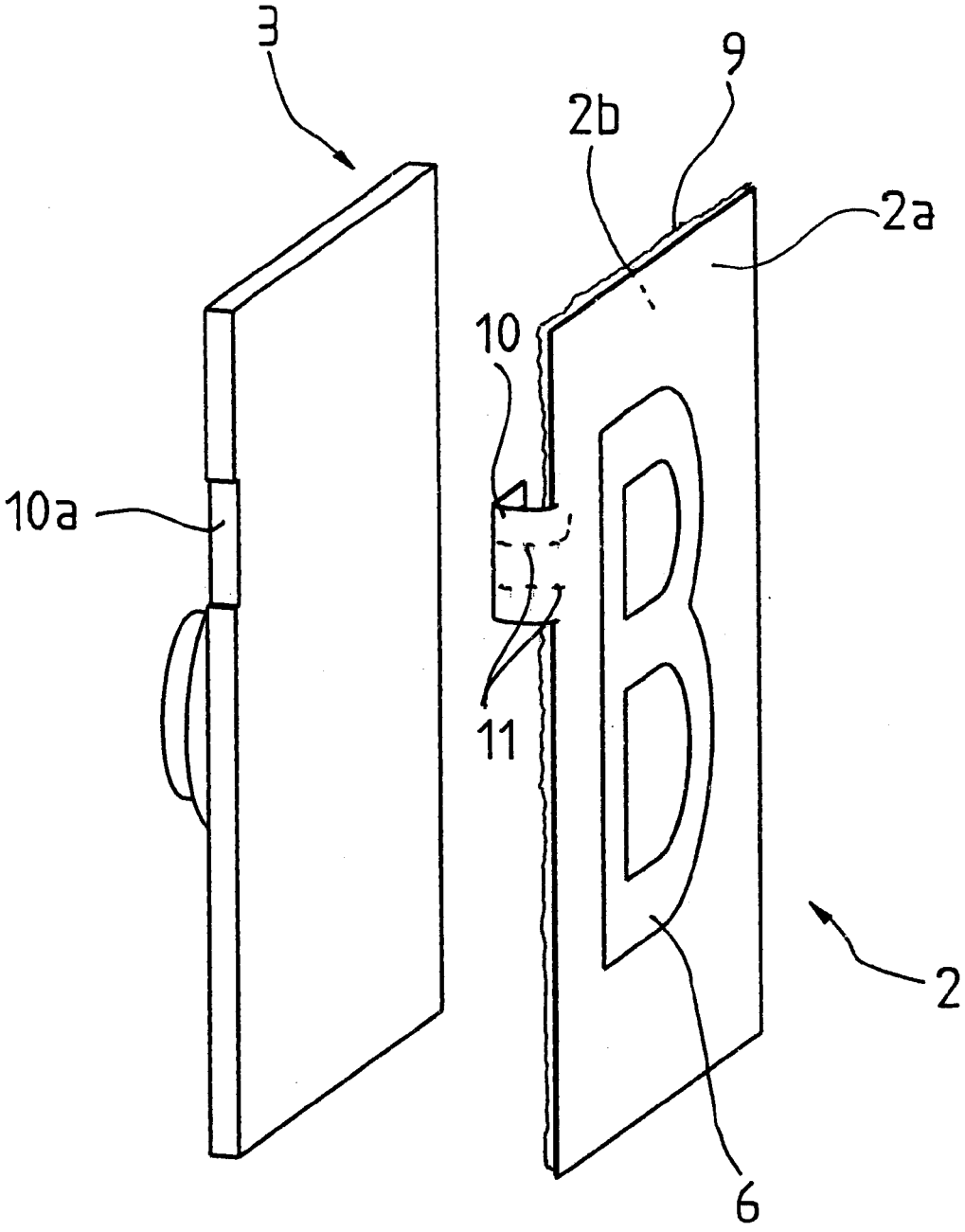
FIG. 2 shows the indicator and the loudspeaker of FIG. 1 in more detail.

In FIG. 2 there is illustrated a detail of the indicating device 1 shown in FIG. 1 in which the EL film 2 and the flat loudspeaker 3 are shown in more detail. The EL film 2 has the front side or illuminated side 2*a* and a back side or rear side 2*b*. The symbol 6, denoted as the letter "B", is readable on the front side 2*a*. A layer of adhesive 9, by means of which the EL film 2 is fixedly connected with the loudspeaker 3, is applied to the rear side 2*b* that faces the loudspeaker 3. The loudspeaker 3 is thus glued to the rear side 2*b* of the EL film 2 in the installed state.

The EL film 2 further includes a flexible tongue 10 extending from a side edge and which has a pair of electrical terminals 11 for the drive control and thus for illumination of the EL film. The two terminals 11 are sufficient in order to cause illumination of the EL film 2, i.e. the EL lamp. The tongue 10 is bent around a corresponding groove 10*a* formed in an adjacent side edge of the panel 3*a* of the flat loudspeaker 3. The ends of the electrical terminals 11 thus lie on the rear side of the flat loudspeaker 3 in the installed state, i.e. on the side of the flat loudspeaker 3 remote from the EL film 2.

The EL technology employed in the indicating device according to the present invention is based on the principle of thick-film electroluminescence (TFEL). The EL film 2 comprises thick-film EL components. The basic construction is as follows: EL pigments (for example, ZnS:Cu) are arranged between two electrodes (anode and cathode). In electrical terms, this arrangement is like a capacitor. A voltage is applied to the electrodes and through excitation of the electrons in the EL pigment and return thereof into the basic state, radiation is emitted in accordance with the energy band characteristic. The thick-film EL components can be manufactured by means of screen-printing techniques, which is relatively simple by comparison with other technologies. The construction of layers is typically as follows: starting with the carrier material, namely a transparent ITO (indium-tin-oxide) film, there follows a transparent, conductive layer, subsequently the active layer (consisting of EL pigments in a screen-printed matrix), a dielectric non-conductive layer and finally a silver (or graphite) electrode. Typical thicknesses of the printed layers for TFEL components lie in the range of 50 to 60 microns and typical thicknesses of the entire construction lie between, for example, about 200 and 400 microns. In order to achieve a high service life, the individual EL pigments can be encapsulated (for example, aluminum-hydroxide encapsulation) so as to protect them against moisture.

The use of the flat loudspeaker 3 instead of a usual conical loudspeaker produces, apart from a thinner mode of construction, also a more diffuse sound radiation. The angle of radiation is less frequency-dependent than in the case of conventional loudspeakers. In flat loudspeakers, the principle of function is based more on complex vibrations in a panel than on the movement of the diaphragm. The flat loudspeaker 3 is particularly suitable for gluing with the EL film 2.

Figure 3:
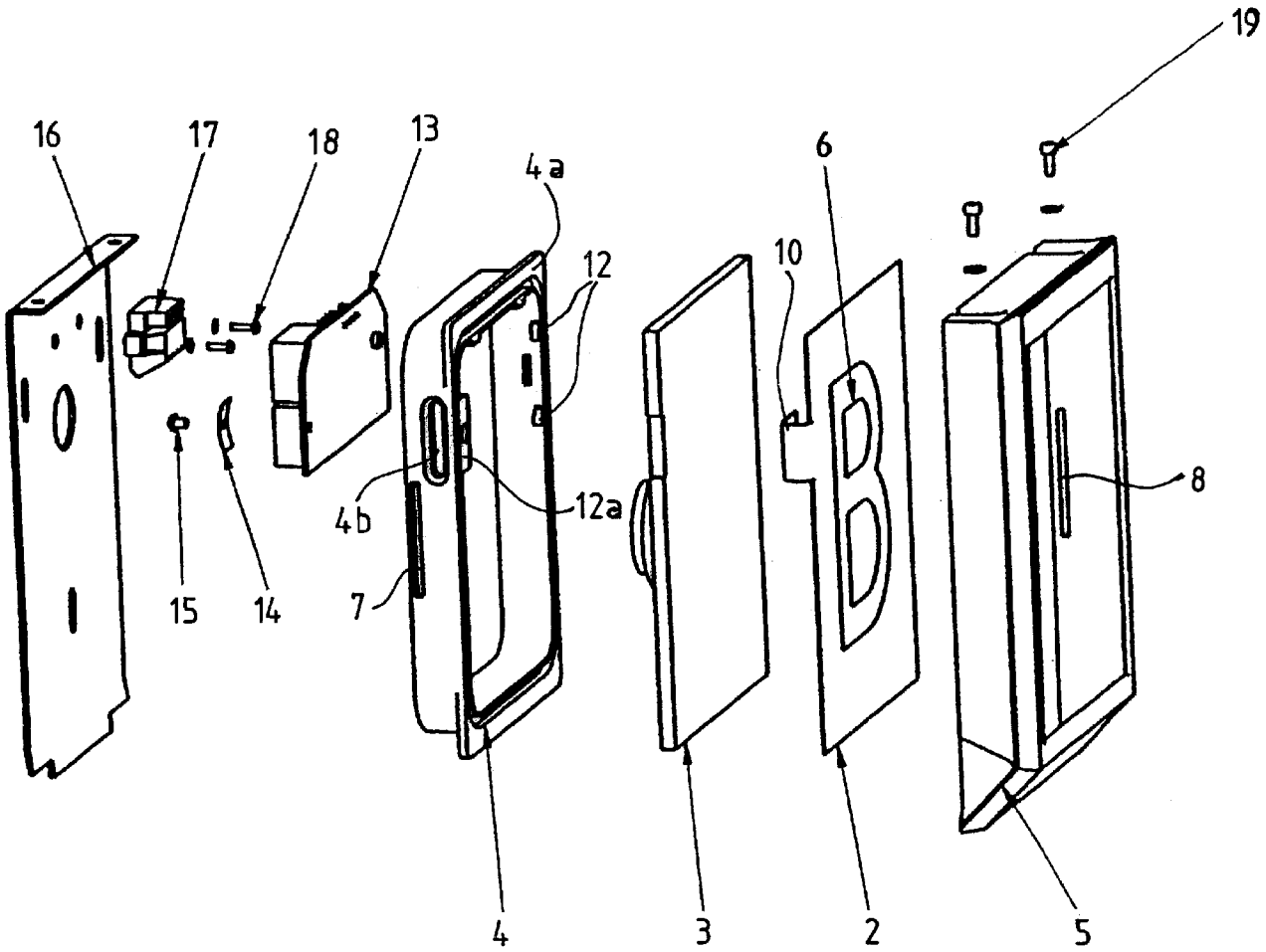
FIG. 3 is an exploded perspective view similar to FIG. 1 with a fixing means.

In FIG. 3 there is illustrated, in addition to the already described components of the indicating device 1, the fixing means by which the entire indicating device is fixed to a wall 20 (FIG. 5) or another favorable position associated with an elevator installation. The inner surface of the side walls of the frame 4 has projections 12 and a support surface 12*a*, which are intended for reception of an electronic assembly 13. The electronic assembly 13 is constructed as a printed circuit board and is thus suspended on the projections 12 and on the support-surface 12*a* of the frame 4. The EL film 2 and the flat loudspeaker 3 are assembled together with the frame 4 and the housing 5. The EL film 2 together with the flat loudspeaker 3 are received in the housing 5. The open back wall of the housing 5 is for that purpose larger than the dimensions of the EL film 2 or the dimensions of the flat loudspeaker 3. Due to the snap connection of the frame 4 with the housing 5 (in the installed state), a rear side of the loudspeaker 3 lies on support surfaces or flanges 4*a* of the frame 4. The frame 4 is sized to be received in the housing 5 through the open rear side.

In one variant, the ends of the electrical terminals 11 of the EL film 2 lie, in the installed state, on the side of the loudspeaker 3 facing the printed circuit board 13. In another variant, the ends of the electrical terminals 11 lie, in the installed state, between the printed circuit board 13 and a spring element 14. In this case, the tongue 10 is bent around the loudspeaker 3 and around a part of the frame 4, wherein the tongue 10 is guided through a cut-out 4*b* formed in a side wall of the frame 4. The printed circuit board 13 and the electrical terminals 11 are pressed together by the spring element 14. The printed circuit board 13 and the spring element 14 are fastened by means of a fastening means 15, for example a screw, to the frame 4. The indicating device 1 further includes a flanged wall mount 16 that serves for mounting the indicating device 1 on the wall 20. A plug connector 17 is mounted on the wall mount 16 by means of further fastening means 18, for example screws. This plug connector 17 is constructed so that it can be inserted into the printed circuit board 13. The wall mount 16 is then fastened to the wall 20. The housing 5, together with all elements already contained therein, i.e. the EL film 2, the flat loudspeaker 3, the frame 4 and the printed circuit board 13, is placed against the wall mount 16 and fixed thereto by means of fastening elements 19, such as, for example, screws. For example, the flange on the wall mount 16 can extend between the upper sides of the frame 4 and the housing 5 with the screws 19 passing through apertures in the housing and threadably engaging apertures in the wall mount. A distortion of the flat loudspeaker 3 is thus avoided, since the frame 4 is clamped between the wall mount 16 and the housing 5.

Figure 4:
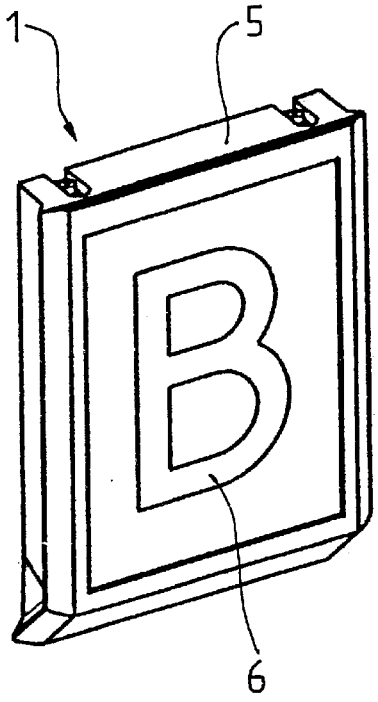
FIG. 4 is a perspective view of the indicating device of FIG. 1 assembled.

FIG. 4 shows the indicating device 1 assembled prior to mounting on the wall 20.

Figure 5:
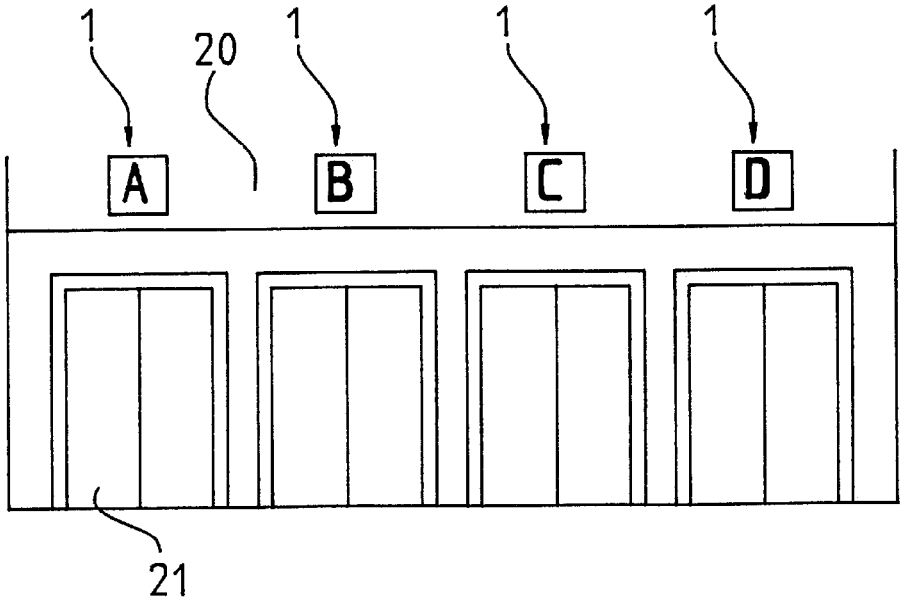
FIG. 5 is an elevation view of an elevator installation using a plurality of the indicating device shown in FIG. 5.

In FIG. 5 there is illustrated a possible use of the indicating device 1 according to the present invention in an elevator installation. One of the indicating devices 1 is arranged above each elevator door 21 and serves as a designation plate for elevator passengers.

In a special embodiment of the indicating device 1 a raster print can be provided on the front side or illuminated side 2*a* of the EL film 2. The body color of the EL film 2 used in the indicating device 1 appears bright gray. This contrasts with the normally used zinc pressure-casting coloration of the housing 5. In order to avoid this contrast and to maintain the impression of a metal plate, the EL film 2 can be subsequently printed with a raster of metallic color. In the case of a mounting height of about two meters, the raster printing is no longer recognizable. The raster is printed so that the illumination of the EL film still remains visible to a sufficient extent. The optical effect of a micro-raster printing in front of an EL film in order to simulate a metallic surface can also be used for other forms of light sources and use locations.

In principle, no limits are imposed on the shape of the indicating device 1. Also, the size can be up to several square meters in theory.

The preferred field of use of the present invention is as a designation plate above the elevator door 21, for example in conjunction with an already known destination call control (for example, the "MICONIC 10" (registered trademark) control available from Schindler Aufzuge AG of Ebikon, Switzerland). In this connection, it fulfills the following tasks:

acoustic guidance for visually-handicapped persons for elevator cars (gong, elevator designation, door status, service reports)

visual guidance of aurally-handicapped persons (flashing).

Further fields of use are possible wherever a combination of acoustic and visual reports appear feasible, for example:

travel direction indicator and acoustic reports to the floor in conventional elevator controls, loudspeaker for communication interfaces and other acoustic reports in combination with an emergency illumination lamp, speech system with signal illumination in and outside the elevator car, and further guidance systems with audio-visual support.

The indicating device 1 according to the present invention could also have several illuminated fields (service reports). The indicating device can be constructed in pixel-like manner with a corresponding number of terminals.

In addition, different forms of the loudspeaker 3 and the film 2 are possible and are simple to realize (oval, circular, etc.).

With the indicating device 1 according to the present invention a simple connection of a lamp with a loudspeaker is produced, which does not cause any acoustic problems, since they are firmly glued together. Thanks to the EL technology, a flat illumination of the lamp is achieved.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An indicating device for an elevator lift installation comprising:

a housing;

a generally planar electroluminescent indicator mounted in said housing, said indicator having a front illuminated side and a rear side; and a sound-reproducing apparatus mounted in said housing adjacent said indicator.

2. The indicating device according to claim 1 wherein said sound-reproducing apparatus is attached to said indicator.

3. The indicating device according to claim 2 wherein said sound-reproducing apparatus is attached to said indicator by an adhesive material.

4. The indicating device according claim 1 wherein said sound-reproducing apparatus is positioned behind said indicator in said housing.

5. The indicating device according to claim 1 wherein said sound-reproducing apparatus and said indicator are enclosed by said housing and a cooperating frame.

6. The indicating device according to claim 1 wherein said sound-reproducing apparatus is a flat loudspeaker.

7. The indicating device according to claim 1 wherein said indicator is constructed in accordance with the principle of thick-film electroluminescence.

8. The indicating device according to claim 1 wherein said indicator is constructed as an electroluminescent lamp.

9. The indicating device according to claim 1 including a fixing means for attaching said housing to a wall of an elevator installation.

10. The indicating device according to claim 9 wherein said fixing means is a wall mount.

11. An indicating device for an elevator lift installation comprising:

a housing having an open front side;

a generally planar electroluminescent indicator mounted in said housing, said indicator having a front illuminated side with a symbol thereon and a rear side, said symbol facing said housing open front side; and a sound-reproducing apparatus mounted in said housing adjacent said indicator.

12. The indicating device according to claim 11 wherein said sound-reproducing apparatus is positioned behind said indicator in said housing.

13. The indicating device according to claim 11 wherein said sound-reproducing apparatus is attached to said indicator by an adhesive material.

14. The indicating device according to claim 11 wherein said sound-reproducing apparatus is a flat loudspeaker.

15. The indicating device according to claim 11 wherein said sound-reproducing apparatus and said indicator are enclosed by said housing and a cooperating frame.

16. The indicating device according to claim 15 including a wall mount for attaching said housing to a wall of an elevator installation, said wall mount being releasably attached to said housing.

17. An indicating device for an elevator lift installation comprising:

a housing having an open front side and an open rear side;

a generally planar electroluminescent indicator mounted in said housing, said indicator having a front illuminated side with a symbol thereon and a rear side, said symbol facing said housing open front side;

a generally planar sound-reproducing apparatus mounted in said housing behind said indicator;

a frame closing said open rear side of said housing; and a wall mount attached to said housing for mounting the indicating device on a wall of an elevator installation.

* * * * *